United States Patent [19]

Petranyí

[11] 4,211,328

[45] Jul. 8, 1980

[54] PACKAGE FOR SOLID OR PASTY GOODS

[75] Inventor: Pál I. Petranyí, Hamburg, Fed. Rep. of Germany

[73] Assignee: Lever Brothers Company, New York, N.Y.

[21] Appl. No.: 9,634

[22] Filed: Feb. 5, 1979

[30] Foreign Application Priority Data

Feb. 7, 1978 [NL] Netherlands ..... 7801366

[51] Int. Cl.[2] ..... B65D 85/74

[52] U.S. Cl. ..... 206/525; 229/43; 215/231

[58] Field of Search ..... 206/525, 521, 523; 220/23, 66, 67, 426, 427; 229/43; 215/231

[56] References Cited

U.S. PATENT DOCUMENTS

| | | | |
|---|---|---|---|
| 1,808,136 | 6/1931 | Gray | 206/521 |
| 3,266,705 | 8/1966 | Wood | 206/523 |
| 3,273,779 | 9/1966 | Myklely | 206/523 |
| 3,306,967 | 2/1967 | Turkewitsch | 206/523 |
| 3,372,795 | 3/1968 | Logan | 206/523 |
| 3,853,221 | 12/1974 | Boyd | 206/523 |

FOREIGN PATENT DOCUMENTS

| | | | |
|---|---|---|---|
| 2437968 | 2/1976 | Fed. Rep. of Germany | 206/523 |
| 2102691 | 4/1972 | France | 206/521 |
| 2210173 | 9/1974 | France | 206/521 |

*Primary Examiner*—Herbert F. Ross

[57] ABSTRACT

A package for solid or pasty goods which have a tendency to adhere to the packaging material has a closure in which on the side facing the packaged goods a plurality of separate, independent cavities (1, 21, 31) have been provided. The cavities are separated from each other by ribs (2) or flat surfaces. The ribs or flat surfaces shut off the cavities containing air or gas by their contact with the surface of the packaged goods. As a result of the cavities not filled with the packaged article, the force required for taking off the closure is reduced and no or hardly any parts of the packaged article such as e.g. margarine keep adhering to the closure.

The closure can consist of deep-drawn or embossed film or can have been made by embossing of cardboard coated with plastics.

10 Claims, 5 Drawing Figures

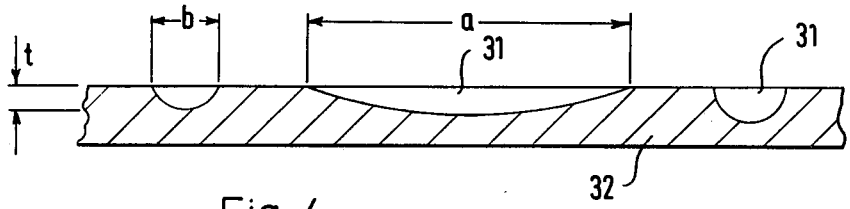
Fig. 4
Fig. 5
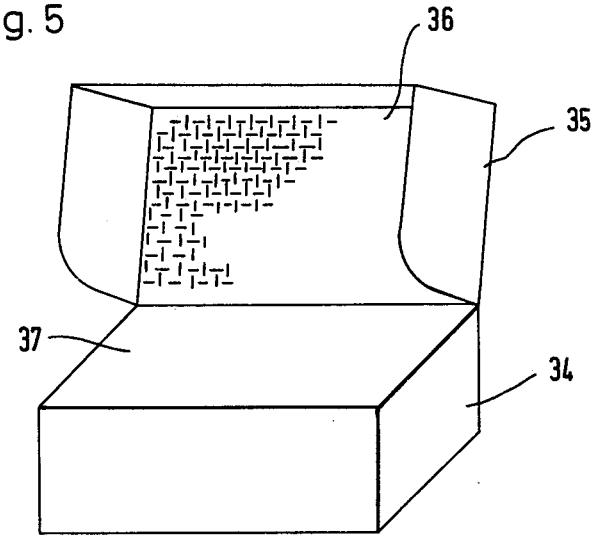

Fig.1
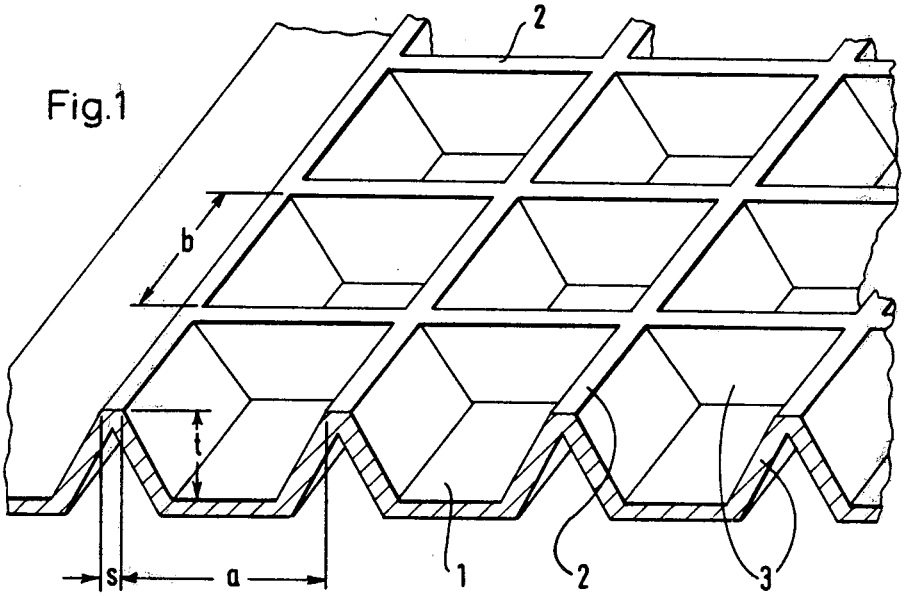
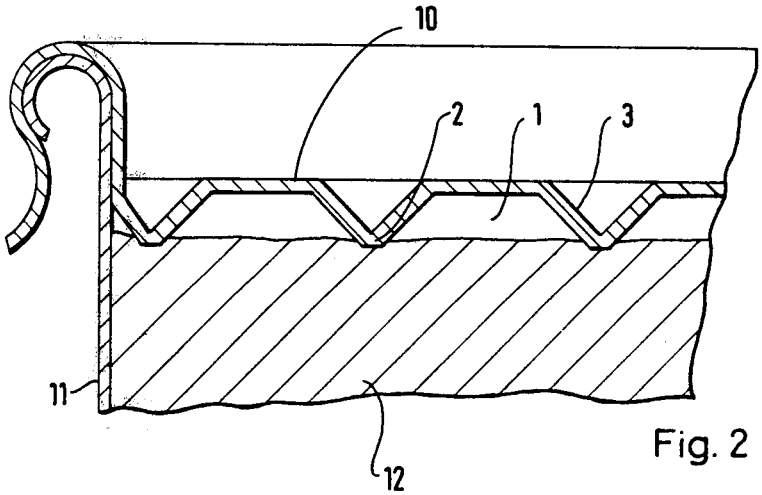
Fig. 2
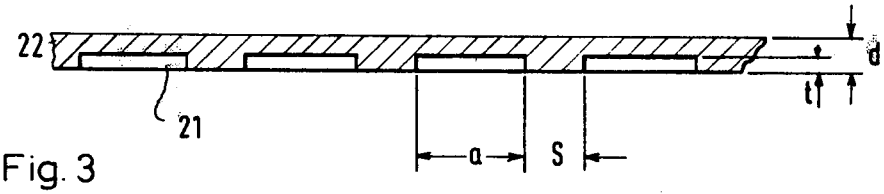
Fig. 3

PACKAGE FOR SOLID OR PASTY GOODS

BACKGROUND OF THE INVENTION

The present invention relates to a package for solid or pasty goods which have the tendency to remain on or adhere to the packaging material and relates particularly to the closure of this package. The package is particularly intended for fats and fat-containing foodstuffs, especially for margarine. Package and closure can consist of any suitable material and also have any usual form, such as e.g. that of a box, beaker, tray etc. The material of the closure should, however, be impervious on the side facing the goods to be packaged and durably deformable. Known packaging materials such as aluminium foil and plastics film, as well as cardboard provided with a layer of plastics, can be used for this.

With known packages, for example for margarine, the problem arises that the lid adheres to the contents, as a result is difficult to remove therefrom and thus part of the contents are pulled out with the lid. Up to now no satisfactory solution is known that could reduce adhering of the contents to the inner side of the lid to a sufficient degree.

SUMMARY OF THE INVENTION

According to the present invention the surface of the closure facing the goods to be packaged is provided with a great number of recessed parts, cavities, pits and suchlike, separate from and independent of each other (referred to in the rest of the text as "cavities"), which have been made and are shaped in such a way that when the lid is put on and pushed down against the packaged goods the cavities are not filled therewith. The closure provided with cavities can be the lid, formed from an aluminium foil or plastics film, of a tray or beaker, a separate sheet of this material that is placed on the contents under the lid, or a removable side surface or lid, provided with a layer of plastics, of a foldable cardboard box.

Surprisingly it appeared that a closure of which the side facing the contents has been provided with small cavities, recesses and suchlike adhered less to the contents and partly even not at all. On the other hand it appeared that surfaces on which the cavities are connected with each other adhere to the contents just as much as a smooth surface of the closure. Therefore it can be assumed that, because of the contact of the edges of these cavities with the surface of the packaged goods, air or gas remains in the small, independently placed cavities. These air cushions in the cavities would appear to be somewhat compressed by the contents of the package and later promote the separation between lid and surface of the contents when the lid is removed. The ribs or flat surfaces between the cavities leave behind an impression on the upper surface of the packaged goods which is retained when the lid is removed. The shape of the separate small elevations on the contents suggests that these elevations have not filled the cavities in the lid entirely.

Shape, size and position of the cavities according to the invention can be varied to a considerable extent. In doing this, account should be taken of the possibilities offered by the packaging material for the formation of the cavities, the properties of the goods to be packaged and possibly also the methods of putting on and pressing down the closure. According to the invention, the area of the ribs or flat surfaces, facing the contents, which are in connection with each other between and around the cavities is up to 90% of the total area of the lid placed on the packaged goods. The open area of a cavity can have a size of 1 to about 30 $mm^2$, this open area being measured in about the plane through the upper side of the ribs or flat surfaces which are connected with each other. The maximum depth of each cavity is 0.15 to 1.5 mm, but can still be greater if need be. The cavities can have any given cross-section and be, for example, round, oval, square or triangular. When the lid is put on, care must be taken that the ribs around the cavities shut the space of the cavities through contact with the surface of the contents, before the air escapes out of them. For surfaces of goods which are already comparatively smooth before the lid is put on, just a few shallow cavities are quite sufficient. If on the other hand the contents are first spread out by pressing the lid on the goods and an almost smooth surface is obtained, then optimum measurements have to be fixed.

DESCRIPTION OF THE DRAWINGS

FIG. 1 shows a part of a deep-drawn film with cavities according to the invention;

FIG. 2 shows a section of a part of a beaker with a deep-drawn lid;

FIG. 3 shows a section of a film with cavities which have been obtained by embossing;

FIG. 4 shows a section of a cardboard material provided with cavities;

FIG. 5 shows a folding box, the lid of which is provided with cavities according to FIG. 4.

FIG. 1 shows the side of a deep-drawn film of polystyrene or polyvinylchloride which is to be placed on the goods to be packed. The film is for example 0.2 mm thick. By means of deep-drawing, a number of cavities 1 have been obtained between which are ribs 2, connected with each other. The cavities have an open square cross section in the plane of the ribs 2 of a×b and a depth, with respect to the plane of the ribs, of t. The width of the ribs is indicated with s. The side walls 3 of the cavities 1 are at an angle of about 60° with respect to the plane of the ribs 2. The edges between the surfaces of the ribs and the cavities can also be somewhat rounded.

In FIG. 2 a deep-drawn beaker lid 10 on a beaker 11 filled with margarine 12 is shown. The lid 10 lies with the ribs 2 on the margarine and presses slightly into its surface. In this example the side walls 3 are at an angle of 45°. In the cavities 1 air cushions form which are separated from each other because of the contact of the ribs 2 with the surface of the margarine 12.

In the preferred embodiment of a closure of a plastics film the cavities 1 and the connected ribs 2 between them were obtained by deep-drawing. With lids 10 for beakers 11 or tubs it is advantageous to carry out the deep-drawing of the area of the lid that is to be placed on the contents simultaneously with the other usual deformations of the lid. This gives a corresponding pattern on the outside of the lid. Printing of the material for the lids is in this case carried out before the deep-drawing.

Lids deep-drawn from a film of 0.2 mm thickness for margarine beakers having an opening with a cross-section of 12.5 cm lengthwise and 8.5 cm crosswise with round corners were provided with different patterns according to FIGS. 1 and 2. The cavities had the shape of a truncated pyramid of square cross-section and an angle of the side walls of 60°. The square cavities were arranged in such a way that a diagonal of the open areas is in the tub's longitudinal direction. The ribs had rounded edges and the pattern pressed by them in the surface of the margarine was a little wider than twice the thickness of the film. The lids were mechanically placed on fresh soft margarine in the beakers. After storage at 15° C. for three and others for six weeks, the lids were removed by tearing off in the longitudinal direction of the beakers. Table 1 shows how much margarine was adhering to the removed lids.

Table 1

| a = b(mm) | a × b(mm²) | t (mm) | (g) Margarine on the lid |
|---|---|---|---|
| ca. 1.5 | 2.2 | 0.3 to 0.4 | 1.5 ± 0.2 |
| 1.5 | 2.2 | 0.5 to 0.6 | 1.7 ± 0.1 |
| 2.0 | 4.0 | 0.3 to 0.4 | 1.5 ± 0.2 |
| 2.0 | 4.0 | 0.5 to 0.6 | 0.5 ± 0.2 |
| 2.5 | 6.2 | 0.5 to 0.6 | 1.0 ± 0.2 |
| 3.0 | 9.0 | 0.5 to 0.6 | 2.7 ± 0.8 |
| 5.0 | 25.0 | 0.5 to 0.6 | 3.0 ± 0.7 |
| conventional lid with smooth surface | | | 4.0 ± 1.7 |

The margarine still present in the case of lids with cavities was mainly near the edges of the lids where the surface of the margarine had apparently been pressed more strongly sidewards by the lid. On the lid used up to now and having a smooth surface this whole surface was covered with margarine.

The test showed that the best results were obtained with deep-drawn lids for margarine beakers when the open area of each cavity was about a×b=2.0 to 6.5 mm² and the depth of the cavities t=0.4 to 0.6 mm. A depth of 0.3 mm seems to be a minimum for deep-drawn lids or films to prevent the margarine from filling in the cavity. However, a depth greather than 1.2 mm for square cavities or 1.5 mm for other forms of cavities is not required and may create difficulties on deep-drawing the lids. A maximum depth of 1.5 mm may e.g. be deep-drawn if the cavity has the shape of a hemisphere.

In FIG. 3 a film 22 is shown in which square cavities 21 have been made by embossing. The film had a thickness d of 0.35 mm and the depth of the cavities was t=0.15 mm. The length a of the edge of the cavities was 1 mm and the width of the ribs between the cavities was s=0.5 mm. These cavities or such having somewhat different dimensions can be made in a known manner on a suitable calender, e.g. immediately after manufacturing the films.

The films 22 were placed as protective covers on the fresh margarine in the beakers, the margarine beakers closed by an additional lid were stored at 15° C. for about 6 weeks and subsequently heated to 20° C. Others were stored at 5° C. and opened at this temperature. Upon removal of the protective covers it appeared that there was barely any margarine adhering to the side of the films provided with cavities.

Protective covers of the same film were also placed with the smooth side on the margarine, after which the same treatment followed. When they were removed it appeared that almost the whole surface of the smooth side was covered with margarine.

From tests with margarine sorts of different composition and with different plastics films it could be established that the making of cavities in the side of the closure that is to be placed on the packaged goods invariably yielded a clear advantage in comparison with the use of the same material without cavities and that the influence of the packaging material as well as of the composition of the contents and of the temperature is comparatively slight.

The good separating effect of the different patterns of cavities appeared not only from the fact that the closures, except for a place here and there, particularly near the edges, were completely freed of the sticking of the contents to them, but could also be determined by the degree to which less force was necessary to remove the closure, as the following Table 2 shows, in which the force for tearing off the protective covers shown in FIG. 3, i.e. with cavities, is compared with a cover, placed with its smooth side on the margarine.

Table 2

| | at 20° C. | | at 5° C. | |
|---|---|---|---|---|
| margarine | smooth film | film with cavities | smooth film | film with cavities |
| sort 1 | 0.13 (N) | 0.08 (N) | 1.40 (N) | 0.06 (N) |
| sort 2 | 0.33 (N) | 0.21 (N) | 0.90 (N) | 0.12 (N) |
| sort 3 | 0.10 (N) | 0.05 (N) | 0.65 (N) | 0.09 (N) |
| sort 4 | 0.43 (N) | 0.14 (N) | 0.66 (N) | 0.37 (N) |

The folding box shown in FIG. 5 has a tip-up lid 35, to the inner side 36 of which the contents 37 of the box 34 kept adhering. Hence the lid was difficult to open. As a result of a pattern, shown in FIG. 5, embossed on the inner side 36 of the cardboard material, adhering could be reduced considerably. The pattern consists of oval cavities which are arranged in rows next to each other with a varying longitudinal direction of the cavities. This pattern was made, for example with the aid of a wire lattice, on the inner side of a cardboard material provided with a coating of plastics e.g. a polyethylene layer, which material can be durably deformed and is impervious to the goods. The pattern consisted of cavities 31 staggered with respect to each other which, in correspondence with the impression of the wire lattice, were oval and had the dimensions a×b=1.0×0.3 to 1.0×0.1 mm. A maximum depth t of the cavities of up to 0.25 mm was measured. FIG. 4 shows a section of this cardboard material. The wire lattice used in this example had a mesh width of 1×1 mm and a wire thickness of 0.35 mm and made about 64 cavities per cm². The use of other wire lattice, however, also resulted in there being less force necessary for opening the package and in less margarine adhering to the lid. With these patterns too, the embossing may only be carried out so far that the cavities 31 are not mutually connected. Lid surfaces in which the cavities 31 were interconnected exhibited no better result than smooth lids.

Other embodiments have cavities which are approximately oval and have an open area of 0.8×0.1 mm to 2.0×0.5 mm. They were arranged in the same way as described above and could be used for margarine with goods results.

Since an embossed film with cavities according to FIG. 3 and a cardboard material according to FIG. 4 are more rigid than and not so flexible as a thin deep-drawn film, a maximum depth of each of the cavities of 0.15 mm or a little more is sufficient for a good separating effect of these materials.

The total area of the ribs or flat surfaces which are connected and come into contact with the surface of the margarine or a similar solid or pasty article can vary broadly. In the case of a pattern embossed by a wire lattice into a cardboard material or a plastics film the connected surfaces surrounding the embossed cavities may be up to 90% of the total area of the lid placed on the surface of the goods.

Through the application of cavities the adherence of the closures to the margarine could clearly be reduced, particularly in packages which are sealed immediately after being filled with margarine and in which the margarine only crystallized out completely in the course of the following days. However, good separating effects can also be expected for other solid or pasty goods which have a tendency to stick or adhere to lids of packages.

What is claimed is:

1. A package with pasty contents, comprising a container having an open top and a closure detachably covering said open top, said container being filled with a substantially solid, pasty material, said pasty material terminating with an upper surface at a prescribed level of and proximate said open top of said container, and a self-shape-sustaining flexible closure operatively associated with said container, said closure being impervious to air and said pasty material and including a plurality of ribs terminating in a plane and defining a pattern of independent and separate non-communicating cavities, with said closure closing said open top of said container said ribs being engaged with said upper surface of said pasty material and cooperating with the latter to seal air in each of said cavities and exclude the full ingress of said pasty material into said cavities.

2. A package according to claim 1 comprising said closure in which the cavities have the shape of a truncated pyramid of a square cross-section, the angle of its side walls being 45° to 60°.

3. A package according to claim 2 comprising a closure in which the cavities have an open area of 2 to 6.5 $mm^2$, measured in the plane of the surrounding ribs, and a depth of 0.4 to 0.6 mm.

4. A package according to claim 1 comprising said closure in which the cavities have an open area of at least 1 $mm^2$ and a depth of at least 0.15 mm.

5. A package and its contents as claimed in claim 1, wherein said container is a folding box and said closure is a lid integral with said box, said box and lid being made of cardboard material, said lid having an impervious plastics coating engageable with said pasty material.

6. A package and its contents as claimed in claim 5 wherein said lid has an embossed pattern of oval cavities arranged in rows in which adjacent cavities have respective longitudinal axes of different direction.

7. A package and its contents as claimed in claim 1 wherein said closure and container are entirely separable from one another.

8. A package and its contents as claimed in claim 1 in which the cavities of said closure are deep-drawn into it.

9. A package and its contents as claimed in claim 1 in which the cavities of said closure are embossed into it.

10. A package and its contents as claimed in claim 1 in which said pasty material is an edible food.

* * * * *